US009187972B2

(12) United States Patent
Di Lullo et al.

(10) Patent No.: US 9,187,972 B2
(45) Date of Patent: Nov. 17, 2015

(54) METHOD FOR STOPPING OR AT LEAST REDUCING THE UNCONTROLLED RELEASE OF HYDROCARBONS, BLOWOUT, FROM A HYDROCARBON EXTRACTION WELL

(71) Applicant: Eni, S.P.A., Rome (IT)

(72) Inventors: Alberto Giulio Di Lullo, Tribiano (IT); Giambattista De Ghetto, San Donato Milanese (IT)

(73) Assignee: ENI S.P.A., Rome (IT)

( * ) Notice: Subject to any disclaimer, the term of this patent is extended or adjusted under 35 U.S.C. 154(b) by 0 days.

(21) Appl. No.: 14/349,021

(22) PCT Filed: Sep. 26, 2012

(86) PCT No.: PCT/IB2012/055125
§ 371 (c)(1),
(2) Date: Apr. 1, 2014

(87) PCT Pub. No.: WO2013/050905
PCT Pub. Date: Apr. 11, 2013

(65) Prior Publication Data

US 2014/0224501 A1 Aug. 14, 2014

(30) Foreign Application Priority Data

Oct. 3, 2011 (IT) ..... MI2011A1782

(51) Int. Cl.

| | |
|---|---|
| ***E21B 33/076*** | (2006.01) |
| ***E21B 33/13*** | (2006.01) |
| ***E21B 33/035*** | (2006.01) |
| ***E21B 43/01*** | (2006.01) |

(52) U.S. Cl.
CPC ..... *E21B 33/0355* (2013.01); *E21B 33/076* (2013.01); *E21B 33/13* (2013.01); *E21B 43/0122* (2013.01)

(58) Field of Classification Search
CPC ... E21B 33/0355; E21B 33/076; E21B 33/13; E21B 43/0122
USPC ..... 166/364, 349, 363, 285, 90.1, 192, 193
See application file for complete search history.

(56) References Cited

U.S. PATENT DOCUMENTS

| | | | | |
|---|---|---|---|---|
| 3,170,516 | A * | 2/1965 | Corley, Jr. et al. | 166/286 |
| 3,765,486 | A * | 10/1973 | Matthews et al. | 166/290 |
| 3,844,351 | A | 10/1974 | Sutton et al. | |
| 6,153,562 | A | 11/2000 | Villar et al. | |
| 7,527,095 | B2 * | 5/2009 | Bloess et al. | 166/265 |
| 8,205,677 | B1 * | 6/2012 | Salkin | 166/363 |
| 8,215,405 | B1 * | 7/2012 | Carrascal | 166/363 |

(Continued)

*Primary Examiner* — Matthew Buck
(74) *Attorney, Agent, or Firm* — Tarolli, Sundheim, Covell & Tummino LLP

(57) ABSTRACT

Method for stopping or at least reducing the uncontrolled release of hydrocarbons, blowout, from a well for the extraction of hydrocarbons, which comprises introducing high-density solids at the bottom of the well, through a suitable line, having a polyhedral, spheroidal, ellipsoidal or paraboloidal form, regular or irregular, possibly coated with swelling polymeric material in contact with the fluids leaving the well, the smallest dimension of said solids being greater than 1 mm and the largest dimension less than 100 mm, so that said solids introduced accumulate by random packing at the bottom of the well, forming a column which totally, or at least partially, blocks the uncontrolled release of said hydrocarbons.

13 Claims, 5 Drawing Sheets

(56) References Cited

U.S. PATENT DOCUMENTS

| | | | | |
|---|---|---|---|---|
| 8,322,431 | B2 * | 12/2012 | Ezell et al. | 166/344 |
| 8,651,185 | B2 * | 2/2014 | Hermes | 166/286 |
| 2002/0096330 | A1 | 7/2002 | James et al. | |
| 2009/0308611 | A1 * | 12/2009 | Santra et al. | 166/293 |
| 2011/0290501 | A1 * | 12/2011 | Duncan et al. | 166/363 |
| 2011/0315381 | A1 * | 12/2011 | Streetman | 166/292 |
| 2012/0093584 | A1 * | 4/2012 | Johnson | 405/74 |

* cited by examiner

METHOD FOR STOPPING OR AT LEAST REDUCING THE UNCONTROLLED RELEASE OF HYDROCARBONS, BLOWOUT, FROM A HYDROCARBON EXTRACTION WELL

The present patent application relates to a process for stopping or at least reducing the uncontrolled release of hydrocarbons, blowout, from a well for the extraction of hydrocarbons.

Even if this process can be mainly applied to offshore wells, it can also be used for onshore wells.

The constant increase in the worldwide demand for hydrocarbon fluids has led to a growing activity in underwater or offshore exploration and production.

Underwater environments, in addition to making production more difficult, create an increased risk of environmental damage in the case of blowout events, i.e. uncontrolled release of hydrocarbons from the extraction wells, and/or other uncontrolled leakages of hydrocarbons into the sea, for example as a consequence of fractures of underwater piping.

These events, even if rare, not only cause a loss in terms of energy, but can also create severe consequences in terms of personal safety, environmental pollution and well restoration costs.

In the field of offshore drilling, the wells are kept under control by means of a column of mud which provides a hydrostatic load that is sufficient for maintaining the difference in pressure between the well and external pressure at controlled values.

This column of mud, also known as primary control barrier of the well, is present both inside the well and also in a tube called riser which connects the drilling plant to the seabottom.

Furthermore, at the seabottom, in correspondence with the well heads, there are generally secondary well control devices, called blowout preventers or BOPs, which act as valves and can close the well in the case of uncontrolled leakages of fluids from the well itself.

In the case of the breakage of the riser, for example, with the consequent loss of static load of the column of mud present in the riser, which is typically higher than the static charge due to the sea depth, the BOPs are closed. This operation prevents entering a blowout condition of the well.

In rare cases, generally due to exceptional natural events such as a solution, for example, there can be the accidental removal of both the riser and the BOPs installed at the seabottom, making it impossible to prevent the well from entering a blowout condition.

Analogously, blowout accidents can also occur before the installation of the BOPs.

In the case of a blowout of an underwater well, various techniques can currently be used for recovering control of the well, such as, for example, bridging, capping, the creation of a relief well and killing.

Bridging is a non-controllable event, being the spontaneous collapsing of the well in blowout condition which generally takes place in the presence of ample sections of open hole.

Capping is a valve closing technique widely used in onshore blowouts but difficult to apply offshore, especially at great depths.

The creation of a relief well is currently the safest and most widely-used technique, but involves lengthy times, in the order of months, and extremely high costs.

A killing intervention consists in the insertion of a specific string of extension rods (killing string) inside a blowout well, which allows conventional killing techniques to be applied such as the circulation of heavy mud, closure by means of shutters or inflatable packers, and so forth.

This method can at present only be used in the case of well blowouts in shallow water, i.e. less than 1,000 m depth, which offers the possibility of reasonable underwater visibility conditions and also the possibility of moving the killing string relatively easily by means of the drilling plant.

An objective of the present invention is to reduce the operation times for stopping the blowout (a few days against the weeks/months necessary with current techniques), also overcoming the possible drawbacks mentioned above, thanks to the injection into the well of high-density solids having suitable dimensions.

A further objective of the present invention is to ensure closure at the well bottom: which can therefore also be applied in cases in which the integrity of the well allows neither closure at the head nor the killing of the well by pumping mud from the BOP.

The process, object of the present invention, for stopping or at least reducing the uncontrolled release of hydrocarbons, blowout, from a well for the extraction of hydrocarbons, comprises introducing high-density solids at the bottom of the well, through a suitable line, preferably having a density higher than 7,000 kg/m$^3$, more preferably higher than 10,000 kg/m$^3$, having a polyhedral, spheroidal, ellipsoidal or paraboloidal form, regular or irregular, the smallest dimension being greater than 1 mm, preferably greater than 2.5 mm, and the largest dimension less than 100 mm, preferably less than 50 mm, so that said solids introduced accumulate by random packing at the bottom of the well, forming a column which totally, or at least partially, blocks the uncontrolled release of said hydrocarbons.

The solids must consist of or contain a material which allows to achieve a high density in order to guarantee their sinking also under extremely high blowout flow-rate conditions: among materials that can be used, lead or tungsten are recommended.

The form of the solids introduced is preferably spheroidal, more preferably selected from spheres, oblate spheroids (flattened spheres) and prolate spheroids (oblong spheres), or polyhedral, preferably selected from cubes and cylinders.

In the case of both spheres and cubes, the smallest dimension and largest dimension obviously coincide and consequently the preferred ranges must correspond to minimum and maximum values of the same dimension.

At least part of the solids introduced can be coated or contain a swelling material in contact with the liquids released during the blowout, hydrocarbons or water depending on the circumstances, preferably selected from a polymer or resin.

In this case, the density of the solid coated by the swelling material or containing the swelling material is preferably higher than 7,000 kg/m$^3$ and the density of the material forming the coated solid, without the swelling material, is higher than 10,000 kg/m$^3$.

The function of this swelling material is to fill, by expansion, the empty spaces left free by the solids during the spontaneous packing and in this way stop or significantly reduce the uncontrolled flow of hydrocarbons from the well.

These solids coated with a swelling polymer or resin can be produced in various ways, among which:

- coating single solids with a layer of molten polymer or in the form of latex, subsequently dried;
- coating single solids with a granular swelling material suitably glued to the surface of the solid itself;

producing balls or other forms of swelling polymer or resin and filling them with one or more solids to increase their weight.

The alternative solution to coated solids, i.e. solids containing swelling material, can be achieved, for example, through shells, or similar forms which open, at the well bottom temperature, releasing a suitable polymer which, on polymerizing or swelling, occludes the spaces between the same solids.

The swelling resin or polymer is preferably selected from those sensitive to the presence of hydrocarbons. The volumetric swelling of the resin or polymer may preferably vary from 50 to 8,000%, depending on the product used and the thickness applied.

These products are commercially available and represent the known art, as also the application techniques to the solids (such as spheres or balls, . . . ).

The ratio between solids introduced neither coated nor containing swelling material/solids introduced coated or containing swelling material is preferably selected from 5/1 to 1/5.

The surface of the solids can be smooth or rough in relation to the coating requirements or availability.

The method according to the present invention can be effected on any type of well for the extraction of hydrocarbons, in particular offshore wells in which secondary well control devices, so-called blowout preventers (BOPs) are preferably present.

The suitable insertion line for introducing the solids at the bottom of the underwater well should preferably connect the floater of the underwater well to the BOP at the bottom of the well: this line can be:

a service line present in the underwater well a new line specifically constructed the casing itself.

A liquid, preferably containing water, possibly viscosized water with the addition of a viscosifying polymer, for example carboxymethyl cellulose or xanthan gum, can be possibly pumped into the introduction line or duct of the solids in concentrations known in the formulation as drilling fluids, at a rate which is sufficient for ensuring that the solids are also carried into horizontal sections of the duct or slight slopes. Once the liquid injected has reached the well, it is carried upwards by the blowout fluids.

The solids can be inserted into the injection duct, at the outlet of the pumps, with simple devices already existing, possibly optimized in order to allow said solids to be automatically ejected at a preferred frequency of at least one solid per second, thus reducing the time necessary for stopping the blowout.

As ejection devices can be used or adapted, for example, those for injecting ball sealers (plastic balls, pumped with acid, which improve the stimulation efficiency) into the well.

The characteristics of the well and flow determine the parameters of the intervention: height, column, number and size of the solids, type of polymer and thickness, suitable alternation of solids without swelling material/solids coated with or containing swelling material (alternation necessary for preventing, in the absence of an overlying weight, the swollen solids from floating and rising up in column), viscosity and flow-rate of the carrier liquid (seawater).

From the calculations, it emerges that, even in the absence of a swelling polymer or in the case of inefficiency of the same, in order ensure the stoppage of the blowout, a column of balls 50-100 meters high is required, which is equivalent to a few tens of thousands of balls (depending on the diameter of the open hole and/or casing). When the polymer is effective, on the other hand, as envisaged by the invention, the efficient column can be reduced by an order of magnitude, bringing the balls to a few thousands and reducing the corresponding injection time.

The sealing operation of the well with this system can be effected with two connection schemes from the floater to the BOP:

laterally through the kill line;

on top through direct vertical access to the BOP (using the top cap or an insert pipe activated by dual ROV).

These injection methods can also be applied in the case of onshore wells.

The introduction of high-density solids at the well bottom can preferably be effected through at least the following phases in sequence:

introduction of high-density solids, neither coated nor containing swelling material, having a diameter smaller than 5 mm, possibly in the form of a dispersion diluted in water, so as to form a first column consisting of a bed of said solids having a suitable height;

introduction of high-density solids, coated with swelling resin, having dimensions from 5 to 15 times greater than the high-density solids neither coated nor containing swelling material introduced in the previous phase, so as to form a second column consisting of a bed of said solids having a height preferably between a half of the height of the first column and the double of the height of the first column;

introduction of high-density solids, neither coated nor containing swelling material, having dimensions from 5 to 15 times greater than the high-density solids, neither coated nor containing swelling material, previously introduced, preferably having about the same dimensions as the coated solids introduced in the previous phase, so as to form a third column consisting of a bed of said solids having a height preferably between a half of the height of the first column and the double of the height of the first column.

The characteristics and advantages of the method for stopping or at least reducing the uncontrolled release of hydrocarbons from a well according to the present invention will appear more evident from the following illustrative and non-limiting description, referring to the enclosed schematic drawings, in which.

Figure 3:
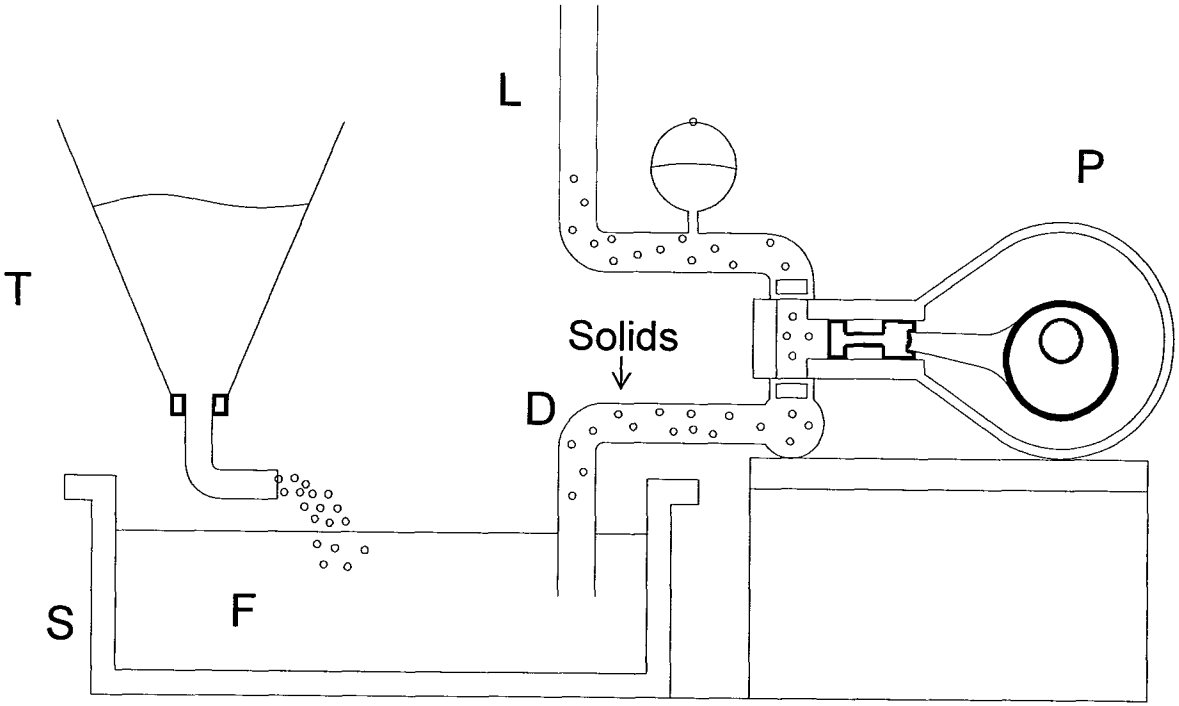
Figure 4:
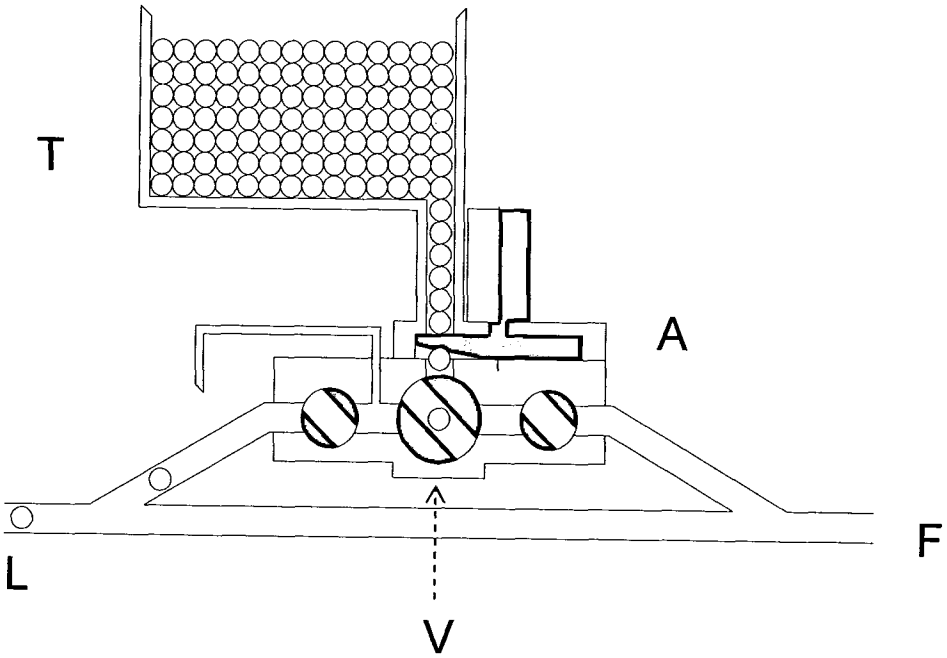
Figure 5:
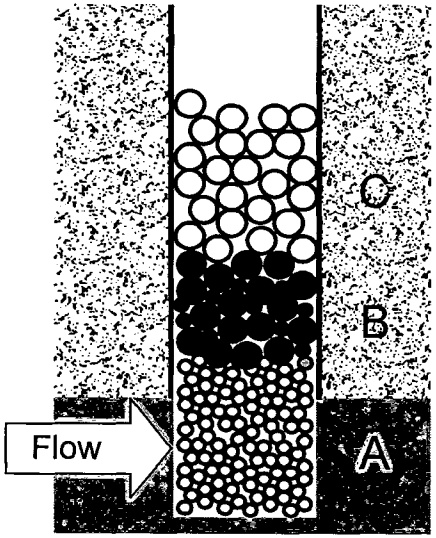

FIG. 3 schematizes a possible implementation of the injection system of heavy solids having small dimensions (indicatively having a maximum diameter of not more than 3 mm), wherein the solids are accumulated in a hopper (T) and mixed in the tank (S) with the fluid (F) so as to form a suspension (D) pumped into the injection lines (L) from the pump (P);

FIG. 4 schematizes an injection device of solids having a larger dimension, i.e. such as not to be able to pass directly into an injection pump, wherein the solids are accumulated in a suitable container and are introduced into an apparatus (A) which, through a specific valve system (V), introduces each solid into the fluid (F) which is flowing in the lines (L);

FIG. 5 represents a stratification of heavy solids, progressively introduced into the well, useful for achieving the objectives claimed in the present invention, i.e. the progressive reduction in the flow-rate of hydrocarbons released into the environment until the complete stoppage of the same, wherein (A) is the first layer of non-coated solids, having small dimensions, injected until the production level is exceeded and a reduction in the blowout flow-rate is observed, (B) is the second layer of solids having larger dimensions coated with the swelling resin, (C) is the third layer of solids having larger dimensions not coated with resin.

The form of the solids, spheroidal, is purely graphical as it can also be in other forms, as already specified in the text.

An embodiment of the method claimed is provided hereunder, which should not be considered as limiting the scope of the claims.

EXAMPLE

Figure 1:
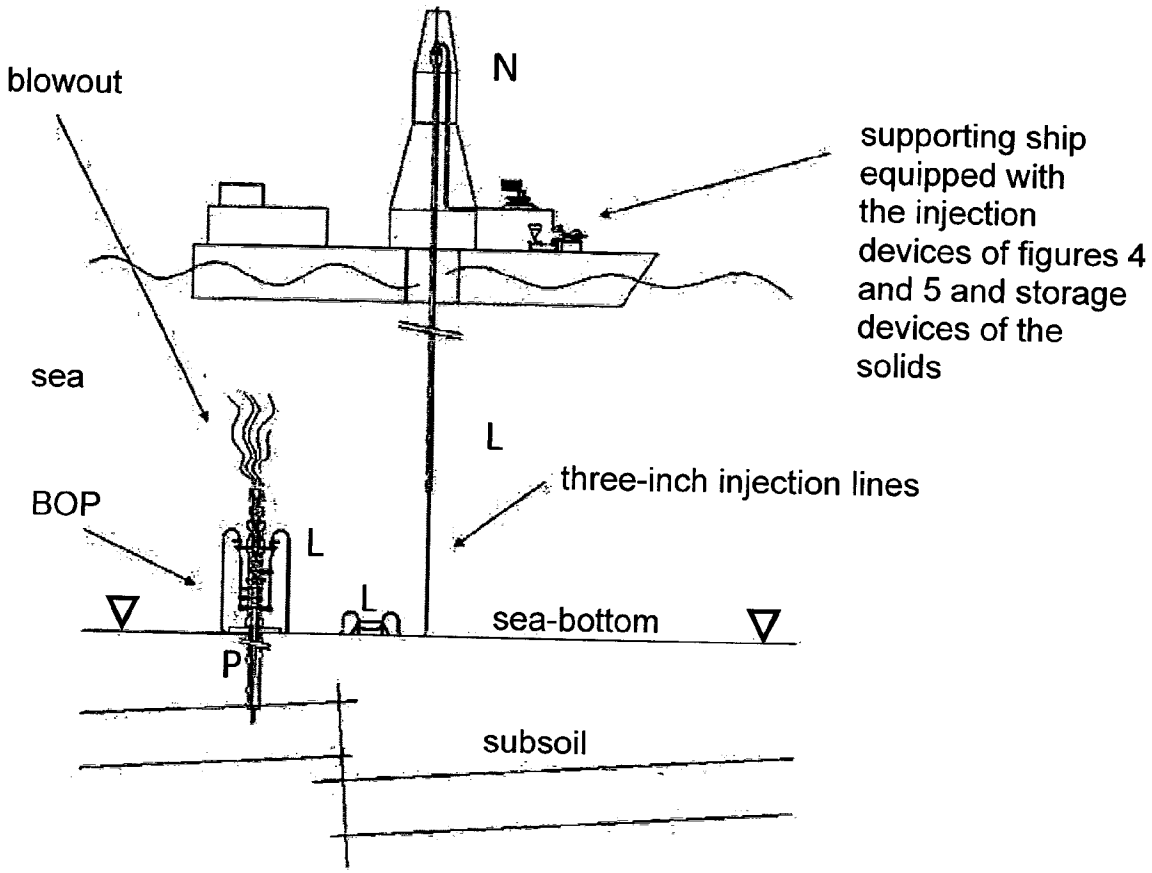
FIG. 1 is schematic representation of a possible applicative context, comprising an offshore well (P) under blowout conditions; an intervention ship (N), which can also coincide with the means used for drilling the well, equipped with the injection devices of FIGS. 4 and 5 and storage devices of the solids, and introduction lines (L) of heavy solids into the well.
Figure 2:
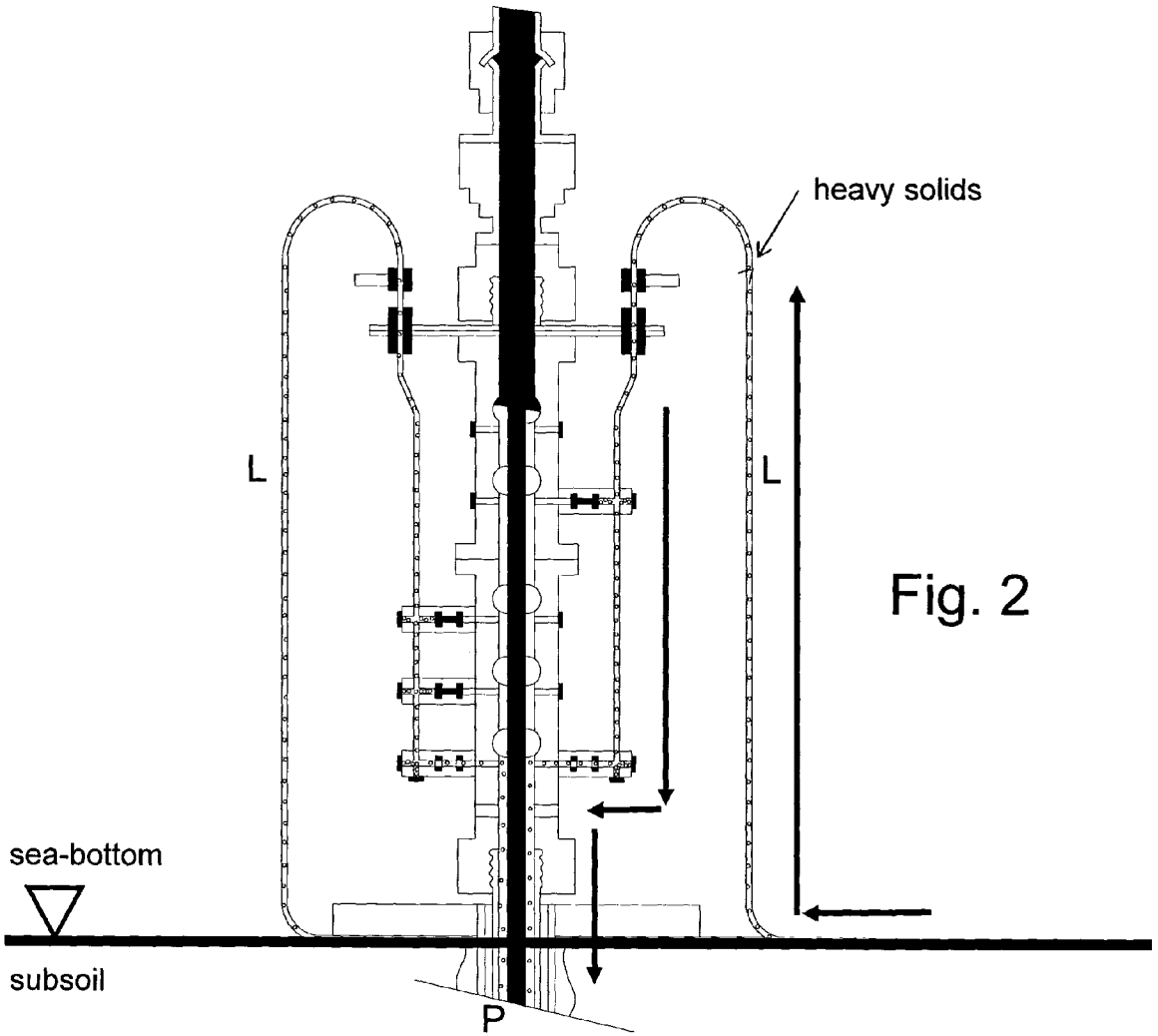
FIG. 2 represents a detail of the possible route of the heavy bodies through the valves and ducts available wherein the arrows indicate the possible route of the solids through the introduction lines into the well (P)

With reference to FIGS. 1, 2 relating to the uncontrolled flow of hydrocarbons from an offshore well, a possible implementation of the present invention is represented by effecting the following operations in sequence:

(A) High-density solids not coated with resin and having small diameter (<3 mm), in the form of a diluted dispersion of spheres in water, are introduced through lines (L) having an internal diameter of 3 inches (FIG. 2), which connect the ship to the underwater BOP. Once these solids have reached the interior of the well, they fall in countercurrent until they reach the well bottom, whereas the water that has carried them, follows the flow of hydrocarbons and leaves the well itself. The injection flow-rate of this dispersion of solids in water is such as to obtain a rate of about 5 m/s in the 3-inch lines. The solids are dispersed in water with a low volume concentration, equal to about 2.5%, and injected by means of the devices illustrated in FIG. 3 or in FIG. 4. This injection operation is prolonged until an evident reduction in the underwater blowout flow-rate is registered. It can be expected, for example, that this reduction requires the formation of a bed of solids having a height equal to about 60 meters, i.e. equal to about 1 $m^3$ of dispersed solids. At the established concentration of solids of 2.5%, this volume would be obtained by injecting about 40 $m^3$ of dispersion into the well. It should be noted, however, that the position of the production level, from which the hydrocarbons are released, is not known and could be different from that at the well bottom. Consequently, as an example, with reference to FIG. 5, it is assumed that a column (A) of solids equal to 240 m must be formed before reaching the production level and that a further 60 m of solid must be accumulated above this level to obtain an observable reduction in the blowout flow-rate. A total of 5 $m^3$ of dispersion must therefore be pumped to obtain the layer of solids called (A). This operation will require about 3 hours to be effected.

(B) A bed, 20 m high, (B) of solids coated with swelling resin, having a larger dimension than the solids of phase (A), is pumped above the bed of small non-coated solids created in the previous phase (A). These solids are injected with the device illustrated in FIG. 4. As an example, an injection frequency of these coated solids equal to about 10 solids/second, is assumed. This flow of solids is carried along the 3-inch injection lines with the same water flow-rate used in phase (A). Considering a weight of each solid equal to about 35 grams, this operation requires the injection of about 250,000 solids into the well and an operating time of about 3 hours.

(C) The injection of coated solids is followed by the injection into the well of a bed (C) 40 m high, of non-coated solids, having the same dimension and form as those of phase (B) and using the same equipment. Following the same analysis as phase (B), this injection requires about 6 hours.

(D) In total, the formation of three beds of solids, of which one of solids coated with swelling resin and two of non-coated solids, requires about 12 hours and leads to a substantial reduction in the flow of hydrocarbons leaving the well. In the subsequent 24-36 hours, the swelling of the resin present in the intermediate layer leads to the complete obstruction of the passage pores of the hydrocarbons, thus causing the complete stoppage of the blowout.

It should be noted that this effect of complete stoppage is thus obtained over a period of 36-48 hours after the beginning of the injection operations of the solids, whereas a substantial reduction in the blowout flow-rate can already be obtained 6 hours after the beginning of the operations.

The solids coated with swelling resin can be obtained by immersion in a resin latex dispersed in water and subsequent drying, possibly at a temperature suitable for the vulcanization of the same resin, to which a vulcanizing agent has been previously added. This vulcanization operation has the effect of preventing the dissolution of the resin in the hydrocarbons, with the possible negative consequence of a re-start up of the flow of hydrocarbons towards the outside of the well, and of delaying the swelling of the resin in order to produce detectable effects about 12 hours after the first contact of the resin with the hydrocarbons.

The invention claimed is:

1. A method for stopping or at least reducing the uncontrolled release of hydrocarbons, blowout, from a well for the extraction of hydrocarbons, the method comprising: introducing high-density solids at the bottom of the well, through a suitable line, having a polyhedral, or spheroidal, elliptical or paraboloidal form, regular or irregular, the smallest dimension being greater than 1 mm and the largest dimension less than 100 mm, so that said solids introduced accumulate by random packing at the bottom of the well, forming a column which totally, or at least partially, blocks the uncontrolled release of said hydrocarbons, wherein the introduction of said solids at the bottom of the well is effected through at least the following phases in sequence:

(1) introduction of high-density solids, neither coated nor containing swelling material, having a diameter smaller than 5 mm;

(2) introduction of high-density solids, coated or containing swelling material, having dimensions from 5 to 15 times greater than the high-density solids neither coated nor containing swelling material introduced in the previous phase; and (3) introduction of high-density solids, neither coated nor containing swelling material, having dimensions from 5 to 15 times greater than the high-density solids, neither coated nor containing swelling material, previously introduced.

2. The method according to claim 1, wherein the density of the solids introduced at the bottom of the well is higher than 7,000 $kg/m^3$.

3. The method according to claim 1, wherein the well is underwater, and in which secondary control devices of the well, called blowout preventers (BOP) are present.

4. The method according to claim 3, wherein the suitable introduction line of the solids connects a floater of the underwater well to the BOP at the bottom of the well.

5. The method according to claim 1, wherein the suitable introduction line of the solids is a service line present in the well, or a new line constructed for this purpose, or is a casing of the well.

6. The method according to claim 1, wherein the externally coating or internally contained swelling material of the solids introduced is selected from a polymer or a resin.

7. The method according to claim 6, wherein the density of the solids externally coated or containing in their interior a swelling material is higher than 7,000 kg/m$^3$ and the density of the material forming the coated solid, without the swelling material, is higher than 10,000 kg/m$^3$.

8. The method according to claim 6, wherein the ratio solids introduced neither coated nor containing swelling material/solids introduced either coated or containing swelling material, from 5/1 to 1/5.

9. The method according to claim 1, wherein the high-density solids introduced in phase (1) are in the form of a dispersion diluted in water, so as to form a first column consisting of a bed of said solids having a suitable height.

10. The method according to claim 9, wherein the high-density solids introduced in phase (2) form a second column consisting of a bed of said solids having a height between half the height of the first column and double the height of the first column.

11. The method according to claim 10, wherein the high-density solids introduced in phase (3) have about the same dimensions as the coated solids introduced in phase (2), so as to form a third column consisting of a bed of said solids.

12. The method according to claim 11, wherein the bed of solids introduced in phase (3) have a height between half the height of the first column and double the height of the first column.

13. High density solids suitable to be introduced through the suitable line into the well in the method of claim 1, said solids having a polyhedral, or spheroidal, or elliptical or paraboloidal form, regular or irregular, the smallest dimension being greater than 1 mm and the largest dimension less than 100 mm, characterized in that the solids contain in their interior swelling material that at well bottom is released and occludes the spaces among the said solids on polymerizing or swelling.

* * * * *